US005409621A

United States Patent [19]

Ellis et al.

[11] Patent Number: 5,409,621

[45] Date of Patent: Apr. 25, 1995

[54] FABRIC SOFTENING COMPOSITION

[75] Inventors: Simon R. Ellis, Little Sutton; Graham A. Turner, Bromborough, both of Great Britain

[73] Assignee: Lever Brothers Company, Division of Conopco, Inc., New York, N.Y.

[21] Appl. No.: 202,849

[22] Filed: Feb. 25, 1994

Related U.S. Application Data

[63] Continuation of Ser. No. 984,064, Nov. 30, 1992, abandoned, which is a continuation-in-part of Ser. No. 857,013, Mar. 24, 1992, abandoned.

[30] Foreign Application Priority Data

Mar. 25, 1991 [GB] United Kingdom ..... 91060308
Jul. 15, 1991 [GB] United Kingdom ..... 9115255

[51] Int. Cl.[6] ..... D06M 13/46

[52] U.S. Cl. ..... 252/8.8; 252/8.6; 252/8.9; 252/547

[58] Field of Search ..... 252/8.6, 8.8, 8.9, 554, 252/547, DIG. 1

[56] References Cited

U.S. PATENT DOCUMENTS

| | | | |
|---|---|---|---|
| 4,137,180 | 1/1979 | Naik et al. | 252/8.8 |
| 4,401,578 | 8/1983 | Verbruggen | 252/8.8 |
| 4,426,299 | 1/1984 | Verbruggen | 252/8.8 |
| 4,429,859 | 2/1984 | Steiner et al. | 252/8.8 |
| 4,840,738 | 6/1989 | Hardy et al. | 252/8.8 |
| 4,844,823 | 7/1989 | Jacques et al. | 252/8.8 |
| 4,855,273 | 8/1989 | Pohl et al. | 502/244 |
| 4,935,556 | 6/1990 | Pohl et al. | 568/885 |
| 4,954,664 | 9/1990 | Carduck et al. | 568/864 |
| 4,965,100 | 10/1990 | Leigh et al. | 427/242 |
| 5,043,485 | 8/1991 | Fleckenstein et al. | 568/885 |
| 5,089,148 | 2/1992 | VanBlarcom et al. | 252/8.6 |
| 5,130,035 | 7/1992 | Dell'Armo et al. | 252/8.6 |
| 5,183,580 | 2/1993 | Lew et al. | 252/8.6 |
| 5,206,203 | 4/1993 | Schneider et al. | 502/304 |
| 5,217,937 | 6/1993 | Schneider et al. | 502/242 |
| 5,288,417 | 2/1994 | Bauer et al. | 252/8.8 |

FOREIGN PATENT DOCUMENTS

| | | |
|---|---|---|
| 0280550 | 8/1988 | European Pat. Off. . |
| WO93/23510 | 11/1993 | WIPO . |

OTHER PUBLICATIONS

R. J. Hunter "Foundations of Colloid Science", Oxford University Press, vol. 1, 1989, p. 571.

Copending application: Singh et al., Ser. No. 07/992,359, filed Dec. 17, 1992.

*Primary Examiner*—Paul Lieberman
*Assistant Examiner*—Michael P. Tierney
*Attorney, Agent, or Firm*—A. Kate Huffman

[57] ABSTRACT

A fabric softening composition comprising a water insoluble cationic fabric softening agent and a nonionic stabilizing agent wherein the water insoluble cationic fabric softening agent is a quaternary ammonium material and the nonionic stabilizing agent is preferably selected from a predominantly linear $C_8$ to $C_{22}$ alcohol alkoxylated with 10 or more moles of alkylene oxide. The nonionic stabilizing agent may also be a $C_{10}$ to $C_{20}$ alcohol or mixtures thereof. For high temperature stability the nonionic stability agent is an alkoxylated alcohol having a clear phase at a 1% concentration in water somewhere in the range of 0° C. and 45° C. and a Krafft point of less than 30° C.

12 Claims, No Drawings

FABRIC SOFTENING COMPOSITION

This application is a continuation of U.S. Ser. No. 07/984,064, filed Nov. 30, 1992, now abandoned which is a continuation-in-part of U.S. Ser. No. 07/857,013 filed Mar. 24, 1992, now abandoned.

FIELD OF THE INVENTION

The present invention relates to fabric softening compositions, in particular the invention relates to aqueous dispersions of biodegradable fabric softening compositions comprising a water insoluble cationic fabric softening agent and a nonionic stabilizing agent suitable as rinse-added fabric softener compositions.

BACKGROUND OF THE INVENTION

Rinse added fabric softener compositions are known. Typically such compositions contain a water insoluble quaternary ammonium fabric softening agent dispersed in water at a level of softening agent up to 7% by weight in which case the compositions are considered dilute, or at levels from 7% to 50% in which case the compositions are considered concentrates. In addition to softening fabric softening compositions desirably have other benefits. One is the ability to confer soil release properties to fabrics, particularly those woven from polyester fibers.

One of the problems associated with fabric softening compositions is the physical instability of such compositions when stored. This problem is accentuated by having a concentrated composition and by storage at either low or high temperatures.

Concentrates and storage stability at extreme low or high temperatures are however desired by the consumer. Physical instability manifests as a thickening on storage of the composition to a level where the composition is no longer pourable and can even lead to the formation of an irreversible gelation of the composition. The thickening is very undesirable since the composition can no longer be conveniently used.

In the past physical stability of rinse added fabric softener compositions has been improved by the addition of viscosity control agents or anti-gelling agents. For example in EP 13780 (Procter and Gamble) viscosity control agents are added to certain concentrated compositions. The agents may include $C_{10}$–$C_{18}$ fatty alcohols. More recently in EP 280550 (Unilever) it has been proposed to improve the physical stability of dilute compositions comprising biodegradable, ester-linked quaternary ammonium compounds and fatty acid by the addition of nonionic surfactants.

With concentrated compositions comprising biodegradable ester-linked quaternary ammonium compounds the problem of physical instability is more acute than with traditional quaternary ammonium compounds.

In EP 0 040 562 (Lesieur Cotelle) a nonionic emulsifier/stabilizer is added to a concentrate comprising an ester-linked quaternary ammonium compound to form a viscous gel. The stabilizer is a $C_{12}$ to $C_{14}$ alcohol ethoxylated with 9 molecules of ethylene oxide. The degree of branching of the alcohol is not, however, mentioned.

Certain nonionic stabilizing agents not only stabilize concentrated compositions comprising biodegradable quaternary ammonium compounds but are also environmentally friendly, in that they show acceptable biodegradability and are not substantially toxic in aquatic systems.

Soil release properties are generally imparted to fabrics by the use of separate soil-release agents, usually a high molecular weight polymer, in a detergent composition or separate treatment. For example in EP 0 398 133A (Procter & Gamble) there is disclosed a cationic polymeric soil release agent for use in a fabric conditioning composition.

A disadvantage of such compositions is that the soil release agent increases the number of components in the formulation, increasing cost and making the product less environmentally acceptable.

We have now found that fabric softening compositions comprising biodegradable ester-linked quaternary ammonium compounds may confer improved soil release properties to fabrics.

We have also found that temperature stability of compositions containing biodegradable quaternary ammonium compounds may be improved by the use of selected nonionic stabilizing agents.

DETAILED DESCRIPTION OF THE INVENTION

According to the invention there is provided a fabric softening composition which is temperature stable comprising a water insoluble cationic fabric softening agent and a nonionic stabilizing agent wherein the water insoluble cationic fabric softening agent is a biodegradable quaternary ammonium material with at least one ester link and the nonionic stabilizing agent is i. a linear $C_8$ to $C_{22}$ alcohol alkoxylated with 10 or more moles of alkylene oxide, preferably 15 to 20 moles of ethylene oxide or ii. a $C_{10}$ to $C_{20}$ alcohol or mixtures thereof.

The compositions of the invention are preferably liquids comprising an aqueous base.

For purposes of this invention, low temperature means a range of less than about 10° C., preferably 0° C. to 10° C. and a high temperature means a range of greater than about 25° C., preferably 25° C. to 45° C.

Preferably, the fabric softening composition comprises a water insoluble cationic which is a compound having two $C_{12\text{-}28}$ alkyl or alkenyl groups connected to the N atom via one or more ester links.

A preferred type of ester-linked quaternary ammonium material for use in the compositions according to the invention can be represented by the formula:

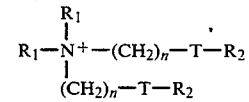

(I)

wherein each $R_1$ group is independently selected from $C_{1\text{-}4}$ alkyl, alkenyl or hydroxyalkyl groups; and wherein each $R_2$ group is independently selected from $C_{8\text{-}28}$ alkyl or alkenyl groups;

T is

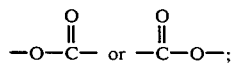

and n is an integer from 0–5.

A second preferred type of quaternary ammonium material can be represented by the formula:

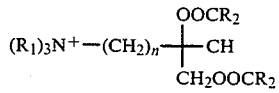

II wherein $R_1$ is independently selected from $C_{1-4}$ alkyl, a hydroxyalkyl group containing from 1 to 4 carbon atoms, of a benzyl group; n and $R_2$ are as defined above.

Preferred materials and their method of preparation are, for example, described in U.S. Pat. No. 4,137,180 (Lever Brothers). Preferably these materials comprise small amounts of the corresponding monoester as described in U.S. Pat. No. 4,137,180 for example 1-tallowoxy, 2-hydroxytrimethyl ammonium propane chloride. Also preferred is a 1,2 dihardened tallowyloxy-3-trimethylammonio propane chloride ex Hoescht.

Preferably the level of ester linked quaternary ammonium compounds is at least 1% by weight of the composition, more preferably more than 3% by weight of the composition; especially interesting are concentrated compositions which comprise more than 7% of ester-linked quaternary ammonium compound. The level of ester-linked quaternary ammonium compounds preferably is between 1% and 80% by weight, more preferably 3% to 50%, most preferably 8% to 50%.

Suitable nonionic stabilizers which can be used in the invention include the condensation products of $C_8$–$C_{22}$ primary or secondary predominantly linear alcohols with 10 or more moles of alkylene oxide, or a $C_{10}$ to $C_{20}$ alcohol or mixtures thereof. To address low temperature stability, it is preferable to select a $C_{10}$ to $C_{20}$ alcohol, alcohol ethoxylates or mixtures thereof as the nonionic stabilizing agent.

To address stability of products at high temperature and in particular stability at 37° C., it is preferable to select the predominately linear alkoxylated alcohols and, in particular, to select those alkoxylated alcohols having a clear phase at a 1% concentration in water somewhere in the range of 0° C. and 45° C. and a Krafft point less than 30° C., preferably less than 10° C. and most preferably less than 5° C.

Krafft point is a term well known in the art, for example from R. J. Hunter 'Foundations of Colloid Science', Oxford University Press, Volume 1, 1989 page 571. In general terms the Krafft point of a stabilizing material is the temperature below which the solubility of the material is low and no micelles are apparent. At temperatures above the Krafft point the solution is clear, at temperatures below it the solution is cloudy. Thus a solution of a material with a Krafft point of 5° C. will be clear between at least 5° C. and 45° C., while a material with a Krafft point of 45° C. will be cloudy between 0° C. and 45° C. and only clear above 45° C.

Use of less than 10 moles of ethylene oxide, especially when the alkyl chain is in the tallow range, leads to unacceptably high aquatic toxicity. Since the aquatic toxicity is related to both the number of moles of ethylene oxide and the length of the alkyl chain we have found that the HLB value can be used as an indication of likely aquatic toxicity. An HLB of greater than about 10 gives rise to an acceptable acute aquatic toxicity value of $>1$ mg/1;$EC_{50}$ 48 hours for daphnia and algae and $EC_{50}$ 96 hours for fish. The selection of linear alcohols and the use of 10 moles or more of ethylene oxide gives acceptable biodegradability to the nonionic stabilizer. The alcohols may be saturated or unsaturated.

Suitable nonionic stabilizing agents for, in particular low temperature stability include Genapol T-110, Genapol T-150, Genapol T-200, Genapol C-200 all ex Hoeschst AG, Lutensol AT18 ex BASF, Genapol C-100 and Genapol C-150 ex Hoechst, or fatty alcohols for example Laurex CS, ex Albright and Wilson or Adol 340 ex Sherex.

To achieve high temperature stability suitable agents having the described Krafft point include Arosurf 66-e 10, Genapol T-150, Genapol T-200, Genapol C-200 all ex. Hoeschst AG, Lutensol At18 ex BASF, Genapol C-100, Genapol C-150 and Genapol T-350 ex Hoechst. Dobanol 91-2.5, Dobanol 91-5, Dobanol 91-6, Dobanol 91-8 ex Shell.

Preferably, the level of nonionic stabilizer used in the invention is within the range from 0.1 to 10% by weight, more preferably from 0.5 to 5% by weight, most preferably from 1 to 4% by weight. The mole ratio of the quaternary ammonium compound to the nonionic stabilizing agent is within the range from 40:1 to about 1:1, preferably within the range from 18:1 to about 3:1.

The composition can also contain fatty acids for example $C_8$–$C_{24}$ alkyl or alkenyl monocarboxylic acids or polymers thereof. Preferably saturated fatty acids are used, in particular, hardened tallow $C_{16}$–$C_{18}$ fatty acids. Preferably the fatty acid is non-saponified, more preferably the fatty acid is free for example oleic acid, lauric acid or tallow fatty acid.

The level of fatty acid material is preferably more than 0.1% by weight, more preferably more than 0.2% by weight. Especially preferred are concentrates comprising from 0.5 to 20% by weight of fatty acid, more preferably 1% to 10% by weight. The weight ratio of quaternary ammonium material to fatty acid material is preferably from 10:1 to 1:10.

The compositions of the invention preferably have a pH of more than 2.0, more preferably between 2 and 5.

The composition can also contain one or more optional ingredients, selected from non-aqueous solvents, pH buffering agents, perfumes, perfume carriers, fluorescers, colorants, hydrotropes, antifoaming agents, antiredeposition agents, enzymes, optical brightening agents, opacifiers, anti-shrinking agents, anti-wrinkle agents, anti-spotting agents, germicides, fungicides, anti-oxidants, anti-corrosion agents, drape imparting agents, antistatic agents and ironing aids.

The composition may also contain nonionic fabric softening agents such as lanolin and derivatives thereof.

The invention will now be illustrated by the following non-limiting examples. In the examples all percentages are expressed by weight.

EXAMPLE 1

Liquid fabric softening compositions were made as follows.

The cationic fabric softening agent, fatty acid and nonionic stabilizing agent where appropriate were premixed and heated together to form a clear melt. The molten mixture thus formed was added over a period of at least one minute, to water at 70° C. to 80° C. with constant stirring to form a dispersion.

The viscosity of the compositions was measured by Haake rotoviscometer following 21 days storage at ambient temperature or at 5° C.

| Composition | A | B | C | D | E |
|---|---|---|---|---|---|
| Arquad 2HT[1] | 12.8 | — | — | — | — |
| HT TMPAC[2] | — | 16 | 16 | 16 | 16 |
| Fatty acid[3] | 3.2 | 2.7 | 2.7 | 2.7 | 2.7 |
| Tallow 11EO[4] | — | 3 | — | — | — |
| Coco 10EO[5] | — | — | 2 | — | — |
| Tallow 20EO[6] | — | — | — | 3 | — |
| Water + minors | | | balance | | |
| Viscosity at $110s^{-1}$ | | | | | |
| Ambient mPas | 159 | 77 | 34 | 43 | 90 |
| 5° C. mPas | 155 | 66 | 38 | 47 | gel |

| Composition | F | G |
|---|---|---|
| HT TMPAC[2] | 11.6 | 12.6 |
| Fatty acid[3] | 1.9 | 2.1 |
| Alcohol[7] | 1.5 | 1.5 |
| Water + minors | balance | |
| Viscosity at $110s^{-1}$ | | |
| Ambient mPas | 53 | 50 |
| 5° C. mPas | 50 | 50 |

Notes

Formulation A corresponds to a commercially available fabric softening composition currently sold in the UK by Lever under the trade mark COMFORT.

[1]Arquad 2HT is dihardened tallow dimethyl ammonium chloride ex Akzo Chemie.

[2]HT TMAPC is 1,2 dihardened tallowyloxy-3-trimethyl-ammonio propane chloride ex Hoescht.

[3]Pristerine 4916 a hardened tallow fatty acid ex Unichema.

[4]tallow alcohol ethoxylated with 11 moles of ethylene oxide of HLB 13.

[5]coco alcohol ethoxylated with 10 moles of ethylene oxide of HLB 14.

[6]tallow alcohol ethoxylated with 20 moles of ethylene oxide of HLB 20.

[7]Laurex CS a tallow alcohol comprising 65-80% $C_{18}$ and 20-23% $C_{16}$ ex Albright and Wilson.

The results show that while known fabric softening compositions comprising conventional quaternary ammonium compounds do not show physical instability, on short term storage at 5° C. (composition A) a problem is experienced with compositions comprising ester-linked quaternaries and fatty acid (composition E). The results also show that addition of selected nonionic stabilizing agents counteract destabilization to give stable concentrated compositions.

EXAMPLE 2

Liquid fabric softening compositions as given below were made as described in Example 1. The soil release properties imparted to polyester test pieces by treatment with the compositions was assessed by measuring the change in reflectance following staining and a subsequent wash in a proprietary detergent composition. The pieces were first rinsed for 5 minutes in 1 liter of 14° FH water containing 0.67 ml of either composition. The pieces were then line dried and stained with 100 micro liters of olive oil containing 0.06% sudan red dye. The stain was allowed to spread for a minimum of two days following which the reflectance of the stained piece ($R_1$) was measured using an ICS micromatch. The pieces were then washed, rinsed and line dried using 5 g/1 New System Persil Automatic ex Lever in 14° FH water for a 15 minute wash cycle. The reflectance of the pretreated, washed piece ($R_2$) was measured and the percentage detergency calculated according to the following equation:

$$\% \text{ Detergency} = \frac{Ks_1 - Ks_2}{Ks_1} \times 100$$

-continued $$\text{where } Ks_1 = \frac{(1 - R_1)^2}{2R_1} \text{ and } Ks_2 = \frac{(1 - R_2)^2}{2R_2}$$

The higher the percentage detergency, the greater the soil release benefit.

| Composition | % by weight A | % by weight B |
|---|---|---|
| Arquad 2HT[1] | — | 12.8 |
| HT TMAPC[2] | 11.6 | — |
| Fatty Acid[3] | 1.9 | 3.2 |
| Tallow 11EO[4] | 2.5 | — |
| Water and minors to balance | | |
| % Detergency | 30 | 21 |

Notes

Formulation B corresponds to a commercially available fabric softening composition, currently sold in the UK by Lever under the trade mark COMFORT. [1, 2, 3] and [4] are as in Example 1.

These results show that known compositions comprising conventional quaternary ammonium compositions (Composition B) show a smaller soil release benefit than compositions according to the invention (Composition A).

EXAMPLE 3

Preferred compositions according to the invention are as follows:

| Composition | % by weight A | % by weight B | % by weight C |
|---|---|---|---|
| HTTMAPC[2] | 11.6 | 11.6 | 11.6 |
| Fatty Acid[3] | 1.9 | 1.9 | 1.9 |
| Tallow 11EO[4] | — | 2.5 | — |
| Tallow Alcohol[7] | 1.5 | — | — |
| Tallow 15EO[8] | — | — | 1.5 |
| Isopropyl alcohol | 1.6 | 1.6 | 1.6 |
| Glycerol | 1.6 | 1.6 | 1.6 |
| Perfume, Dye + minors | 0.8 | 0.8 | 0.8 |
| Water to balance | | | |

Notes

[2, 3, 4] and [7] are as in Example 1

[8]is tallow alcohol ethoxylated with 15 moles of ethylene oxide.

EXAMPLE 4

Liquid fabric softening compositions were made as described in Example 1 and as repeated below for convenience.

The cationic fabric softening agent, fatty acid (and nonionic stabilizing agent where appropriate) were premixed and heated together to form a clear melt. The molten mixture thus formed was added to water at 70° C. to 80° C. over a period of at least one minute, with constant stirring to form a dispersion.

The viscosity of the compositions was measured by Haake rotoviscometer following 1 and 3 months storage at ambient temperature or at 37° C.

The Krafft point was measured by preparing a 1% solution of the nonionic stabilizing agent in distilled water and storing the solution at 5° C. for 5 days. The solution was then heated gradually with stirring until the solution became clear. The temperature at which the solution became clear was taken as the Krafft point.

| Composition | A | B | C | D | E | F | G |
|---|---|---|---|---|---|---|---|
| HT TMAPC[1] | 11.58 | 11.58 | 11.58 | 11.58 | 11.58 | 11.58 | 11.58 |
| Fatty Acid[2] | 1.93 | 1.93 | 1.93 | 1.93 | 1.93 | 1.93 | 1.93 |
| Tallow 11EO[3] | | 2.5 | | | | | |
| Tallow 15EO[4] | | | 1.5 | | | | |
| Tallow 18EO[5] | | | | 1.5 | | | |
| Tallow 20EO[6] | | | | | 1.5 | | |
| Coco 10EO[7] | | | | | | 1.5 | |
| Arosurf 66-e10[8] | | | | | | | 1.5 |
| Water and Minors | | | | Balance | | | |
| Viscosity at $110s^{-1}$ mPas | | | | | | | |
| 1 month Ambient | 164 | 87 | 42 | 17 | 44 | 31 | 80 |
| 1 month 37° C. | 161 | 427 | 28 | 24 | 41 | 58 | 53 |
| 3 months Ambient | 178 | 72 | 35 | — | 39 | 35 | — |
| 3 months 37° C. | 175 | 735 | 53 | — | 38 | 162 | — |
| Krafft point °C. | — | 45 | <5 | <5 | <5 | 35 | <5 |
| Clear phase at 1% concentration in water between 0° C. and 45° C. | — | No | Yes | Yes | Yes | No | Yes |

Notes
[1]HT TMAPC is a 1,2 dihardened tallowyloxy-3-trimethyl-ammonio propane chloride ex Hoescht.
[2]is hardened tallow fatty acid, Pristerine 4916 ex Unichema.
[3]is tallow alcohol ethoxylated with 11 moles of ethylene oxide.
[4]is tallow alcohol ethoxylated with 15 moles of ethylene oxide.
[5]is tallow alcohol ethoxylated with 18 moles of ethylene oxide.
[6]is tallow alcohol ethoxylated with 20 moles of ethylene oxide.
[7]is coco alcohol ethoxylated with 10 moles of ethylene oxide.
[8]is isostearic alcohol ethoxylated with 10 moles of ethylene oxide.

These results show that addition of selected nonionic stabilizing agents to compositions comprising ester linked quaternary ammonium compounds counteracts destabilization at high temperature to give stable concentrated compositions.

We claim:

1. A fabric conditioning composition comprising:

(a) 1–80% of a water insoluble cationic fabric conditioning material of formula:

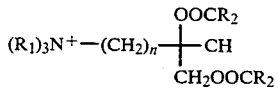

(II)

wherein $R_1$ is independently selected from $C_{1-4}$ alkyl, a hydroxyalkyl group containing from 1 to 4 carbon atoms, or a benzyl group;

each $R_2$ is independently selected from $C_{8-28}$ alkyl or alkenyl groups; and n is an integer from 0 to 5, and (b) 0.1 to 10% of a nonionic stabilizing agent comprising a linear $C_8$–$C_{22}$ alcohol alkoxylated with 10 to 20 moles of alkylene oxide to provide a fabric conditioning composition which is temperature stable at a temperature of less than 10° C. and greater than 25° C.

2. A composition according to claim 1 further comprising 0.1% to 20% by weight of a fatty acid material selected from a group consisting of $C_{8-24}$ alkyl monocarboxylic acid, $C_8$–$C_{24}$ alkenyl monocarboxylic acid, polymers of the alkyl or alkenyl monocarboxylic acids and mixtures thereof.

3. A composition according to claim 2 comprising from 3% to 50% by weight of the water insoluble cationic conditioning material, from 0.5% to 5% by weight of the nonionic stabilizing agent and from 0.5 to 20% by weight of the fatty acid material.

4. A composition according to claim 1 wherein the nonionic stabilizing agent is the $C_8$–$C_{22}$ alcohol ethoxylate which is predominantly linear and has a Krafft point of less than 5° C.

5. A composition according to claim 1 wherein the composition comprises from 3 to 50% by weight of the water insoluble cationic fabric conditioning material, from 0.5% to 5% by weight of the alcohol ethoxylate and from 0.5 to 20% by weight of a fatty acid material.

6. A composition according to claim 4 wherein the alcohol ethoxylate has an HLB of between 10 and 20.

7. A composition according to claim 1 wherein the nonionic stabilizing agent has an HLB of between 10 and 20.

8. A composition according to claim 7 wherein the nonionic stabilizing agent has an HLB of between 12 and 20.

9. A process for making a liquid fabric softening composition comprising the steps of:

(a) mixing and heating together 1–80 wt. % of a water insoluble cationic fabric conditioning material of formula

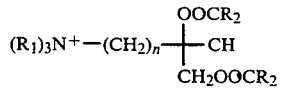

(II)

wherein $R_1$ is independently selected from $C_{1-4}$ alkyl, a hydroxyalkyl group containing from 1 to 4 carbon atoms, or a benzyl group;

each $R_2$ is independently selected from $C_{8-28}$ alkyl or alkenyl groups; and n is an integer from 0 to 5, and 0.1 to 10 wt. % of a nonionic stabilizing agent comprising a linear $C_8$–$C_{22}$ alcohol alkoxylated with 10 to 20 moles of alkylene oxide to form a melt; and (b) dispersing the melt in water to provide a fabric conditioning composition which is temperature stable at a temperature of less than 10° C. and greater than 25° C.

10. A process according to claim 9 wherein the nonionic stabilizing agent is the $C_8$–$C_{22}$ alcohol ethoxylate which is predominantly linear and has a Krafft point of less than 5° C.

11. A process according to claim 9 wherein the cationic fabric softening agent of formula II is present in an amount of from 3 to 50% by weight and the alcohol alkoxylate is present in an amount of from 0.5 to 5% by weight.

12. A process according to claim 9 further comprising mixing 0.5 to 20% by weight of a fatty acid material selected from a group consisting of a $C_8$–$C_{24}$ alkyl monocarboxylic acid, a $C_8$–$C_{24}$ alkenyl monocarboxylic acid, a polymer of the alkyl or alkenyl monocarboxylic acid and mixtures thereof with the cationic fabric conditioning material of formula II.

* * * * *